US008740729B2

(12) United States Patent
Nakamura

(10) Patent No.: US 8,740,729 B2
(45) Date of Patent: Jun. 3, 2014

(54) GOLF BALL

(75) Inventor: Hirotaka Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 379 days.

(21) Appl. No.: 13/290,158

(22) Filed: Nov. 7, 2011

(65) Prior Publication Data

US 2012/0165132 A1 Jun. 28, 2012

(30) Foreign Application Priority Data

Dec. 24, 2010 (JP) ..... 2010-287103

(51) Int. Cl.

| | |
|---|---|
| ***A63B 37/12*** | (2006.01) |
| *A63B 37/04* | (2006.01) |
| *A63B 37/06* | (2006.01) |
| *A63B 37/14* | (2006.01) |

(52) U.S. Cl.
USPC ..... 473/378; 473/377; 473/385

(58) Field of Classification Search
USPC ..... 473/351–385
See application file for complete search history.

(56) References Cited

U.S. PATENT DOCUMENTS

| | | | | |
|---|---|---|---|---|
| 4,681,323 | A * | 7/1987 | Alaki et al. | 473/384 |
| 4,813,677 | A | 3/1989 | Oka et al. | |
| 4,979,747 | A | 12/1990 | Jonkouski | |
| 5,016,887 | A | 5/1991 | Jonkouski | |
| 5,033,750 | A | 7/1991 | Yamagishi et al. | |
| 5,158,300 | A | 10/1992 | Aoyama | |
| 6,053,820 | A * | 4/2000 | Kasashima et al. | 473/378 |
| 6,379,268 | B1 * | 4/2002 | Yamagishi et al. | 473/371 |
| 7,134,974 | B2 * | 11/2006 | Shannon et al. | 473/378 |
| 8,048,958 | B2 * | 11/2011 | Hirau et al. | 525/129 |
| 8,388,466 | B2 * | 3/2013 | Ohama et al. | 473/377 |
| 2005/0187038 | A1 * | 8/2005 | Sasaki et al. | 473/378 |
| 2007/0117655 | A1 * | 5/2007 | Kasashima et al. | 473/371 |

FOREIGN PATENT DOCUMENTS

| | | | | |
|---|---|---|---|---|
| EP | 434913 | A1 * | 7/1991 | A63B 37/14 |
| JP | 62-192181 | A | 8/1987 | |
| JP | 2-134175 | A | 5/1990 | |
| JP | 3-198875 | A | 8/1991 | |
| JP | 4-231079 | A | 8/1992 | |
| JP | 5-237202 | A | 9/1993 | |
| JP | 10248955 | A * | 9/1998 | A63B 37/00 |
| JP | 2000225209 | A * | 8/2000 | A63B 37/00 |

* cited by examiner

*Primary Examiner* — Alvin Hunter
(74) *Attorney, Agent, or Firm* — Birch, Stewart, Kolasch & Birch, LLP

(57) ABSTRACT

A golf ball 2 has, on a surface thereof, a plurality of types of dimples 10 having different diameters from each other. The standard deviation of the curvature radii of cross sections of all the dimples 10 is 0.90 mm or less. The average of the curvature radii of the cross sections of all the dimples 10 is 20% or greater but 40% or less of the diameter of the golf ball. The sum of the volumes of all the dimples is 300 $mm^3$ or greater but 370 $mm^3$ or less. The average of the diameters of all the dimples is 3.5 mm or greater but 4.5 mm or less. The ratio of the sum of the areas of all the dimples to the surface area of a phantom sphere of the golf ball is 75% or greater but 95% or less.

13 Claims, 12 Drawing Sheets

GOLF BALL

This application claims priority on Patent Application No. 2010-287103 filed in JAPAN on Dec. 24, 2010. The entire contents of this Japanese Patent Application are hereby incorporated by reference.

BACKGROUND OF THE INVENTION

1. Field of the Invention

The present invention relates to golf balls. Specifically, the present invention relates to improvement of dimples of golf balls.

2. Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. Excellent dimples efficiently disturb the air flow. The excellent dimples produce a long flight distance.

The ratio of the sum of the areas of dimples to the surface area of a phantom sphere of a golf ball is referred to as an occupation ratio. In general, in a golf ball having a high occupation ratio, the degree of turbulization is great. A golf ball having a high occupation ratio has excellent flight performance.

It is known that the degree of turbulization is great in a golf ball in which the diameters of dimples are less variable. The golf ball has excellent flight performance.

In order to increase an occupation ratio, it is necessary to locate a small-diameter dimple in a narrow zone surrounded by a plurality of dimples. The presence of the small-diameter dimple causes an increase in variation of the diameters of dimples. Increasing an occupation ratio and suppressing the variation of the diameters are incompatible with each other.

The degree of turbulization also depends on the cross-sectional shapes of dimples. In a golf ball in which dimples are too deep, turbulization is insufficient. Also in a golf ball in which dimples are too shallow, turbulization is insufficient.

There have been various proposals for the cross-sectional shapes of dimples. JPS62-192181 (U.S. Pat. No. 4,813,677) discloses a golf ball that has dimples having large diameters and large depths and dimples having small diameters and small depths.

JPH2-134175 (U.S. Pat. No. 5,033,750) discloses a golf ball in which the difference between a value obtained by dividing the diameter of a dimple by the depth thereof and a value obtained by dividing the diameter of another dimple by the depth thereof is equal to or less than 0.3.

JPH3-198875 (U.S. Pat. No. 4,979,747) discloses a golf ball that has dimples having large diameters and small depths and dimples having small diameters and large depths.

JPH4-231079 (U.S. Pat. No. 5,016,887) discloses a golf ball in which values obtained by dividing the depths of all dimples by the diameters thereof are the same.

JPH5-237202 (U.S. Pat. No. 5,158,300) discloses a golf ball in which the edge angles of all dimples are the same.

The greatest interest to golf players concerning golf balls is flight distance. In light of flight performance, there is room for improvement in the shapes of dimples. An object of the present invention is to provide a golf ball having excellent flight performance.

SUMMARY OF THE INVENTION

A golf ball according to the present invention has, on a surface thereof, a plurality of types of dimples having different diameters from each other. A standard deviation of curvature radii of cross sections of all the dimples is equal to or less than 0.90 mm. An average of the curvature radii of the cross sections of all the dimples is equal to or greater than 20% of a diameter of the golf ball but equal to or less than 40% of the diameter of the golf ball. Preferably, the average of the curvature radii of the cross sections of all the dimples is equal to or greater than 20% of the diameter of the golf ball but equal to or less than 35% of the diameter of the golf ball.

In the golf ball according to the present invention, since the standard deviation of the curvature radii is equal to or less than 0.9 mm, the degree of turbulization is great. In the golf ball, the average of the curvature radii is equal to or greater than 20% of the diameter of the golf ball but equal to or less than 40% of the diameter of the golf ball. Thus, when the golf ball is hit with a driver of which a head speed is equal to or greater than 45 m/s but equal to or less than 55 m/s, the degree of turbulization is particularly great. When the golf ball is hit with a driver of which a head speed is equal to or greater than 45 m/s but equal to or less than 55 m/s, a large flight distance is achieved.

Preferably, a sum of volumes of all the dimples is equal to or greater than 300 $mm^3$ but equal to or less than 370 $mm^3$. Preferably, the sum is equal to or greater than 310 $mm^3$ but equal to or less than 360 $mm^3$.

Preferably, an average of the diameters of all the dimples is equal to or greater than 3.5 mm but equal to or less than 4.5 mm.

Preferably, a ratio of a sum of areas of all the dimples to a surface area of a phantom sphere of the golf ball is equal to or greater than 75% but equal to or less than 95%.

The golf ball can comprise a core and a cover. The cover is formed from a resin composition. Preferably, a base resin of the resin composition is a polyurethane.

DESCRIPTION OF THE PREFERRED EMBODIMENTS

The following will describe in detail the present invention, based on preferred embodiments with reference to the accompanying drawings.

Figure 1:
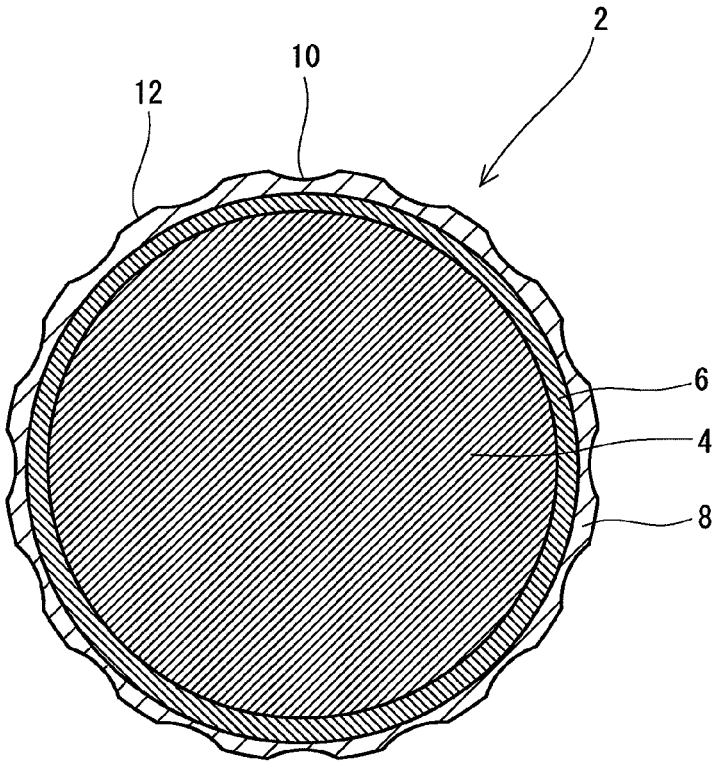
FIG. 1 is a cross-sectional view of a golf ball according to one embodiment of the present invention.

A golf ball 2 shown in FIG. 1 includes a spherical core 4, a mid layer 6 positioned outside the core 4, and a cover 8 positioned outside the mid layer 6. On the surface of the cover 8, a large number of dimples 10 are formed. Of the surface of the golf ball 2, a part other than the dimples 10 is a land 12. The golf ball 2 includes a paint layer and a mark layer on the external side of the cover 8 although these layers are not shown in the drawing.

The golf ball 2 has a diameter of preferably 40 mm or greater but 45 mm or less. From the standpoint of conformity to the rules established by the United States Golf Association (USGA), the diameter is particularly preferably equal to or greater than 42.67 mm. In light of suppression of air resistance, the diameter is more preferably equal to or less than 44 mm and particularly preferably equal to or less than 42.80 mm. The golf ball 2 has a weight of preferably 40 g or greater but 50 g or less. In light of attainment of great inertia, the weight is more preferably equal to or greater than 44 g and particularly preferably equal to or greater than 45.00 g. From the standpoint of conformity to the rules established by the USGA, the weight is more preferably equal to or less than 45.93 g.

The core 4 is formed by crosslinking a rubber composition. Examples of preferable base rubbers for use in the rubber composition of the core 4 include polybutadienes, polyisoprenes, styrene-butadiene copolymers, ethylene-propylene-diene copolymers, and natural rubbers. In light of resilience performance, polybutadienes are preferred. When a polybutadiene and another rubber are used in combination, it is preferred if the polybutadiene is included as a principal component. Specifically, the proportion of the polybutadiene to the entire base rubber is preferably equal to or greater than 50% by weight and more preferably equal to or greater than 80% by weight. The proportion of cis-1,4 bonds in the polybutadiene is preferably equal to or greater than 40% and more preferably equal to or greater than 80%.

In order to crosslink the core 4, a co-crosslinking agent is preferably used. Examples of preferable co-crosslinking agents in light of resilience performance include monovalent or bivalent metal salts of an α,β-unsaturated carboxylic acid having 2 to 8 carbon atoms. Specific examples of preferable co-crosslinking agents include zinc acrylate, magnesium acrylate, zinc methacrylate, and magnesium methacrylate. In light of resilience performance, zinc acrylate and zinc methacrylate are particularly preferred.

In light of resilience performance of the golf ball 2, the amount of the co-crosslinking agent is preferably equal to or greater than 10 parts by weight and more preferably equal to or greater than 15 parts by weight, per 100 parts by weight of the base rubber. In light of soft feel at impact, the amount of the co-crosslinking agent is preferably equal to or less than 50 parts by weight and more preferably equal to or less than 45 parts by weight, per 100 parts by weight of the base rubber.

Preferably, the rubber composition of the core 4 includes an organic peroxide together with a co-crosslinking agent. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. In light of versatility, dicumyl peroxide is preferred.

In light of resilience performance of the golf ball 2, the amount of the organic peroxide is preferably equal to or greater than 0.1 parts by weight, more preferably equal to or greater than 0.3 parts by weight, and particularly preferably equal to or greater than 0.5 parts by weight, per 100 parts by weight of the base rubber. In light of soft feel at impact, the amount of the organic peroxide is preferably equal to or less than 3.0 parts by weight, more preferably equal to or less than 2.8 parts by weight, and particularly preferably equal to or less than 2.5 parts by weight, per 100 parts by weight of the base rubber.

Preferably, the rubber composition of the core 4 includes an organic sulfur compound. Examples of preferable organic sulfur compounds include monosubstitutions such as diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, and the like; disubstitutions such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, and the like; trisubstitutions such as bis(2,4,6-trichlorophenyl)disulfide, bis(2-cyano-4-chloro-6-bromophenyl)disulfide, and the like; tetrasubstitutions such as bis(2,3,5,6-tetrachlorophenyl)disulfide and the like; and pentasubstitutions such as bis(2,3,4,5,6-pentachlorophenyl)disulfide, bis(2,3,4,5,6-pentabromophenyl)disulfide, and the like. The organic sulfur compound contributes to resilience performance. Particularly preferable organic sulfur compounds are diphenyl disulfide and bis(pentabromophenyl)disulfide.

In light of resilience performance of the golf ball 2, the amount of the organic sulfur compound is preferably equal to or greater than 0.1 parts by weight and more preferably equal to or greater than 0.2 parts by weight, per 100 parts by weight of the base rubber. In light of soft feel at impact, the amount of the organic sulfur compound is preferably equal to or less than 1.5 parts by weight, more preferably equal to or less than 1.0 parts by weight, and particularly preferably equal to or less than 0.8 parts by weight, per 100 parts by weight of the base rubber.

For the purpose of adjusting specific gravity and the like, a filler may be included in the core 4. Examples of suitable fillers include zinc oxide, barium sulfate, calcium carbonate, and magnesium carbonate. Powder of a metal having a high specific gravity may be included as a filler. Specific examples of metals having high specific gravities include tungsten and molybdenum. The amount of the filler is determined as appropriate so that the intended specific gravity of the core 4 is accomplished. A particularly preferable filler is zinc oxide. Zinc oxide serves not only as a specific gravity adjuster but also as a crosslinking activator. According to need, various additives such as sulfur, an anti-aging agent, a coloring agent, a plasticizer, a dispersant, and the like are included in the core 4 in an adequate amount. Crosslinked rubber powder or synthetic resin powder may also be included in the core 4.

In light of resilience performance, the core 4 has a central hardness H1 of preferably 35 or greater, more preferably 40 or greater, and particularly preferably 45 or greater. In light of suppression of spin upon a shot with a driver, the central hardness H1 is preferably equal to or less than 80, more preferably equal to or less than 75, and particularly preferably equal to or less than 70. The central hardness H1 is measured by pressing a JIS-C type hardness scale against the central point of a cut plane of the core 4 that has been cut into two halves. For the measurement, an automated rubber hardness measurement machine (trade name "P1", manufactured by Kobunshi Keiki Co., Ltd.), to which this hardness scale is mounted, is used.

In light of resilience performance, the core 4 has a surface hardness H2 of preferably 45 or greater, more preferably 50 or greater, and particularly preferably 55 or greater. In light of feel at impact, the surface hardness H2 is preferably equal to or less than 100, more preferably equal to or less than 95, and particularly preferably equal to or less than 90. The surface hardness H2 is measured by pressing a JIS-C type hardness scale against the surface of the core 4. For the measurement, an automated rubber hardness measurement machine (trade name "P1", manufactured by Kobunshi Keiki Co., Ltd.), to which this hardness scale is mounted, is used.

In light of feel at impact, the difference (H2−H1) between the surface hardness H2 and the central hardness H1 is preferably equal to or greater than 5, more preferably equal to or greater than 8, and particularly preferably equal to or greater than 12. In light of resilience performance, the difference (H2−H1) is preferably equal to or less than 35, more preferably equal to or less than 32, and particularly preferably equal to or less than 30.

In light of feel at impact, the core 4 has an amount of compressive deformation D1 of preferably 2.3 mm or greater, more preferably 2.4 mm or greater, and particularly preferably 2.5 mm or greater. In light of resilience performance, the amount of compressive deformation D1 is preferably equal to or less than 6.0 mm, more preferably equal to or less than 5.5 mm, and particularly preferably equal to or less than 4.0 mm.

At measurement of an amount of compressive deformation, a sphere (the core 4, the golf ball 2, or the like) is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is an amount of compressive deformation.

In light of resilience performance, the core 4 has a diameter of preferably 35.0 mm or greater, more preferably 36 mm or greater, and particularly preferably 37 mm or greater. From the standpoint that the mid layer 6 and the cover 8 having sufficient thicknesses can be formed, the diameter is preferably equal to or less than 42.0 mm, more preferably equal to or less than 41.6 mm, and particularly preferably equal to or less than 41.2 mm.

The core 4 has a weight of preferably 25 g or greater but 42 g or less. The temperature for crosslinking the core 4 is generally equal to or higher than 140° C. but equal to or lower than 180° C. The time period for crosslinking the core 4 is generally equal to or longer than 10 minutes but equal to or shorter than 60 minutes. The core 4 may be formed with two or more layers. The core 4 may have a rib on the surface thereof.

For the mid layer 6, a resin composition is suitably used. Examples of the base polymer of the resin composition include ionomer resins, polystyrene elastomers, polyurethane elastomers, polyester elastomer, polyamide elastomers, and polyolefin elastomers. Ionomer resins are particularly preferred. Ionomer resins are highly elastic. As described later, the cover 8 of the golf ball 2 is thin. When the golf ball 2 is hit with a driver, the mid layer 6 significantly deforms due to the thinness of the cover 8. The mid layer 6 including an ionomer resin contributes to resilience performance upon a shot with a driver.

An ionomer resin and another resin may be used in combination. In this case, in light of resilience performance, the ionomer resin is included as the principal component of the base polymer. The proportion of the amount of the ionomer resin to the total amount of the base polymer is preferably equal to or greater than 50% by weight, more preferably equal to or greater than 70% by weight, and particularly preferably equal to or greater than 85% by weight.

Examples of preferable ionomer resins include binary copolymers formed with an α-olefin and an α,β-unsaturated carboxylic acid having 3 to 8 carbon atoms. A preferable binary copolymer includes 80% by weight or more and 90% by weight or less of an α-olefin, and 10% by weight or more and 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more and 85% by weight or less of an α-olefin, 5% by weight or more and 30% by weight or less of an α,β-unsaturated carboxylic acid, and 1% by weight or more and 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid or methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include trade names "Himilan 1555","Himilan 1557","Himilan 1605","Himilan 1706", "Himilan 1707", "Himilan 1856", "Himilan 1855", "Himilan AM7311","Himilan AM7315","Himilan AM7317","Himilan AM7318", "Himilan AM7320", "Himilan AM7329", and "Himilan AM7337", manufactured by Du Pont-MITSUI POLYCHEMICALS Co., Ltd.; trade names "Surlyn 6120", "Surlyn 6320", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and tradenames"IOTEK 7010", "IOTEK 7030","IOTEK 7510","IOTEK 7520", "IOTEK 8000", and "IOTEK 8030", manufactured by ExxonMobil Chemical Corporation. Two or more ionomer resins may be used in combination. An ionomer resin neutralized with a monovalent metal ion, and an ionomer resin neutralized with a bivalent metal ion may be used in combination.

As described later, the mid layer 6 is hard. An ionomer resin having a high acid content achieves a hard mid layer 6. The acid content is preferably equal to or greater than 10% by weight but equal to or less than 30% by weight. Specific examples of ionomer resins having high acid contents include the aforementioned "Himilan 1605", "Himilan 1706", "Himilan 1707", "Himilan AM7311", "Himilan AM7317", "Himilan AM7318", "Himilan AM7329", "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "IOTEK 8000", and "IOTEK 8030".

Preferable polymers that are used in combination with an ionomer resin are polystyrene elastomers. A styrene block-containing thermoplastic elastomer is particularly preferred. This elastomer includes a polystyrene block as a hard segment, and a soft segment. A typical soft segment is a diene block. Examples of diene compounds include butadiene, isoprene, 1,3-pentadiene, and 2,3-dimethyl-1,3-butadiene. Butadiene and isoprene are preferred. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably equal to or greater than 10% by weight, more preferably equal to or greater than 12% by weight, and particularly preferably equal to or greater than 15% by weight. In light of feel at impact of the golf ball 2, the content is preferably equal to or less than 50% by weight, more preferably equal to or less than 47% by weight, and particularly preferably equal to or less than 45% by weight.

In the present invention, styrene block-containing thermoplastic elastomers include alloys of olefin and one or more members selected from the group consisting of SBS, SIS, SIBS, SEBS, SEPS, SEEPS, and hydrogenated products thereof. The olefin component in the alloy is presumed to contribute to improvement of compatibility with another base polymer. This alloy improves the resilience performance of the golf ball 2. An olefin having 2 to 10 carbon atoms is preferable. Examples of suitable olefins include ethylene, propylene, butene, and pentene. Ethylene and propylene are particularly preferred.

Specific examples of polymer alloys include trade names "Rabalon T3221C","Rabalon T3339C","Rabalon SJ4400N","Rabalon SJ5400N", "Rabalon SJ6400N", "Rabalon SJ7400N", "Rabalon SJ8400N", "Rabalon SJ9400N", and "Rabalon SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "Septon HG-252" manufactured by Kuraray Co., Ltd.

For the purpose of adjusting specific gravity, a filler may be included in the resin composition of the mid layer 6. Examples of fillers that can be used include zinc oxide, barium sulfate, calcium carbonate, and magnesium carbonate. Powder of a metal having a high specific gravity may be included as a filler. Specific examples of metals having high specific gravities include tungsten and molybdenum. The amount of the filler is determined as appropriate so that the intended specific gravity of the mid layer 6 is accomplished. A coloring agent, and crosslinked rubber powder or synthetic resin powder may also be included in the mid layer 6.

The mid layer 6 is hard. The golf ball 2 that includes the hard mid layer 6 has excellent resilience performance upon a shot with a driver. The sphere consisting of the hard mid layer 6 and the core 4 can achieve an outer-hard/inner-soft hardness distribution. When the golf ball 2 having this hardness distribution is hit with a driver, spin is suppressed. The synergistic effect of the resilience performance and the spin suppression achieves excellent flight performance of the golf ball 2. The golf ball 2 having this hardness distribution also has excellent feel at impact. In light of flight performance and feel at impact, the mid layer 6 has a hardness Hm of preferably 50 or greater, more preferably 58 or greater, and particularly preferably 62 or greater. In light of feel at impact and durability, the hardness Hm is preferably equal to or less than 85, more preferably equal to or less than 80, and particularly preferably equal to or less than 75.

In the present invention, the hardness Hm of the mid layer 6 is measured according to the standards of "ASTM-D 2240-68". For the measurement, an automated rubber hardness measurement machine (trade name "P1", manufactured by Kobunshi Keiki Co., Ltd.), to which a Shore D type spring hardness scale is mounted, is used. For the measurement, a sheet that is formed by hot press, that is formed from the same material as that of the mid layer 6, and that has a thickness of about 2 mm is used. Prior to the measurement, a sheet is kept at 23° C. for two weeks. At the measurement, three sheets are stacked.

In light of flight performance, the mid layer 6 has a thickness Tm of preferably 0.5 mm or greater, more preferably 0.7 mm or greater, and particularly preferably 0.9 mm or greater. In light of feel at impact, the thickness Tm is preferably equal to or less than 2.4 mm, more preferably equal to or less than 2.1 mm, and particularly preferably equal to or less than 1.7 mm.

For forming the mid layer 6, known methods such as injection molding, compression molding, and the like can be used. In light of productivity, injection molding is preferred.

In light of feel at impact, the sphere consisting of the core 4 and the mid layer 6 has an amount of compressive deformation Dm of preferably 2.0 mm or greater, more preferably 2.1 mm or greater, and particularly preferably 2.2 mm or greater. In light of resilience performance, the amount of compressive deformation Dm is preferably equal to or less than 3.8 mm, more preferably equal to or less than 3.7 mm, and particularly preferably equal to or less than 3.6 mm.

The cover 8 is formed from a resin composition. Examples of the base polymer of the resin composition include polyurethane elastomers, polyester elastomers, polyamide elastomers, polyolefin elastomers, polystyrene elastomers, and ionomer resins. Polyurethane elastomers are particularly preferred. Polyurethane elastomers are flexible. When the golf ball 2 is hit with a short iron, the cover 8 enters the grooves of a clubface. Due to this entry, a slip between the golf ball 2 and the clubface is suppressed. In the golf ball 2 that includes the cover 8, a high spin rate is obtained. The cover 8 contributes to the controllability of the golf ball 2.

A polyurethane elastomer and another resin may be used in combination for the cover 8. In this case, in light of controllability, the polyurethane elastomer is included as the principal component of the base polymer. The proportion of the amount of the polyurethane elastomer to the total amount of the base polymer is preferably equal to or greater than 50% by weight, more preferably equal to or greater than 70% by weight, and particularly preferably equal to or greater than 85% by weight.

For the cover 8, thermoplastic polyurethanes and thermosetting polyurethanes can be used. In light of productivity, thermoplastic polyurethanes are preferred. A thermoplastic polyurethane includes a polyurethane component as a hard segment, and a polyester component or a polyether component as a soft segment. Examples of a curing agent for the polyurethane component include alicyclic diisocyanates, aromatic diisocyanates, and aliphatic diisocyanates.

Examples of alicyclic diisocyanates include 4,4'-dicyclohexylmethane diisocyanate ($H_{12}MDI$) 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferred.

Examples of aromatic diisocyanates include 4,4'-diphenylmethane diisocyanate (MDI) and toluene diisocyanate (TDI). Examples of aliphatic diisocyanates include hexamethylene diisocyanate (HDI).

Alicyclic diisocyanates are particularly preferred. Because an alicyclic diisocyanate does not have any double bond in the main chain, the alicyclic diisocyanate suppresses yellowing of the cover 8. Two or more diisocyanates may be used in combination.

Specific examples of thermoplastic polyurethanes include trade names "Elastollan ET370", "Elastollan ET870-11V", "Elastollan 1154D", "Elastollan 1175A10W", "Elastollan C60A10WN", "Elastollan C70A10WN", "Elastollan RVP2002", "Elastollan XNY80A", "Elastollan XNY85A", "Elastollan XNY90A", "Elastollan XNY97A", "Elastollan XNY585", and "Elastollan XKP016N", manufactured by BASF Japan Ltd.; and trade names "RESAMINE P4585LS" and "RESAMINE PS62490", manufactured by Dainichiseika Color & Chemicals Mfg. Co., Ltd.

The cover 8 may be formed from a composition that includes a thermoplastic polyurethane and a polyisocyanate compound. During or after forming the cover 8, the polyurethane is crosslinked with the isocyanate compound.

According to need, a coloring agent such as titanium dioxide, a filler such as barium sulfate, a dispersant, an antioxidant, an ultraviolet absorber, a light stabilizer, a fluorescent material, a fluorescent brightener, and the like are included in the cover 8 in an adequate amount. For the purpose of adjusting specific gravity, powder of a metal having a high specific gravity, such as tungsten, molybdenum, and the like, may be included in the cover 8.

The cover 8 has a hardness Hc of preferably 30 or greater. The cover 8 suppresses spin when being hit with a driver. In this respect, the hardness Hc is more preferably equal to or greater than 32 and particularly preferably equal to or greater than 38. In light of controllability when being hit with a short iron, the hardness Hc is preferably equal to or less than 60, more preferably equal to or less than 57, and particularly preferably equal to or less than 54. The hardness Hc of the cover 8 is measured by the same method as that for the hardness Hm of the mid layer 6.

In light of controllability, the cover 8 has a thickness Tc of preferably 0.1 mm or greater, more preferably 0.2 mm or greater, and particularly preferably 0.3 mm or greater. In light of flight performance, the thickness Tc is preferably equal to or less than 1.2 mm, more preferably equal to or less than 1.0 mm, and particularly preferably equal to or less than 0.8 mm.

For forming the cover 8, known methods such as injection molding, compression molding, cast molding, and the like can be used. The golf ball 2 may include a reinforcing layer between the mid layer 6 and the cover 8.

Figure 2:
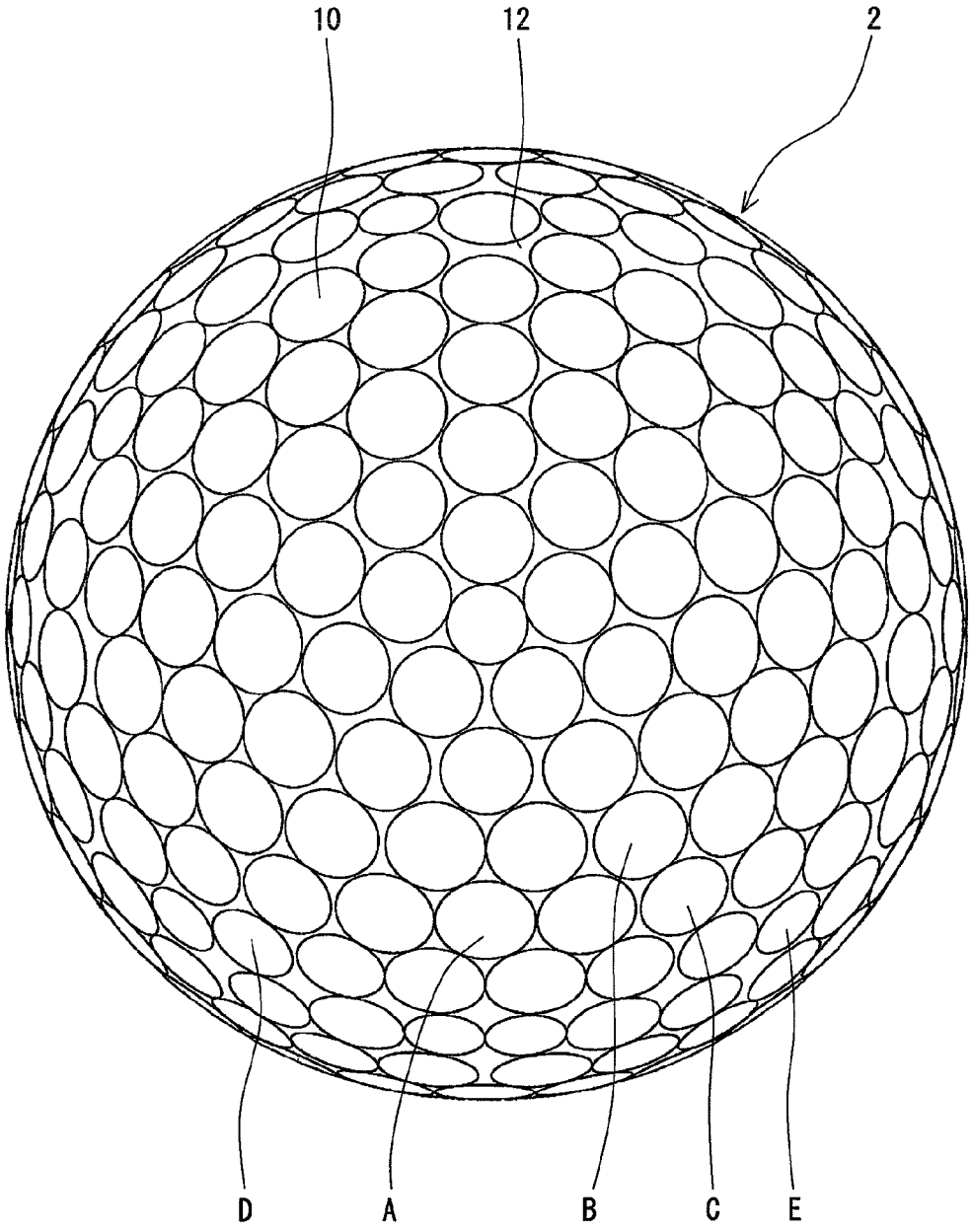
FIG. 2 is an enlarged plan view of the golf ball in FIG. 1.
Figure 3:
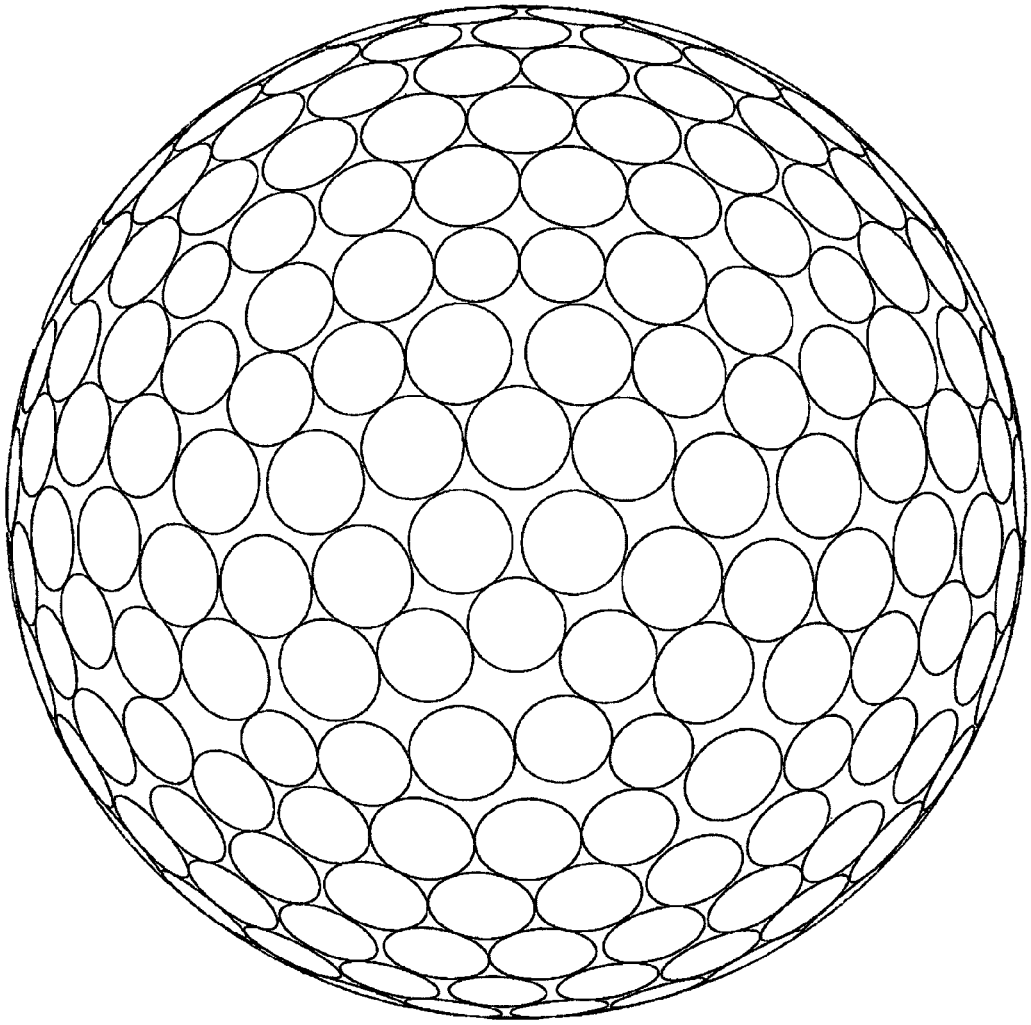
FIG. 3 is a front view of the golf ball in FIG. 2.

As shown in FIGS. 2 and 3, the contour of each dimple 10 is circular. The golf ball 2 has dimples A each having a diameter of 4.50 mm; dimples B each having a diameter of 4.40 mm; dimples C each having a diameter of 4.30 mm; dimples D each having a diameter of 4.10 mm; and dimples E each having a diameter of 3.60 mm. The number of types of the dimples 10 is five.

The number of the dimples A is 108; the number of the dimples B is 78; the number of the dimples C is 20; the number of the dimples D is 100; and the number of the dimples E is 18. The total number TN of the dimples 10 is 324.

Figure 4:
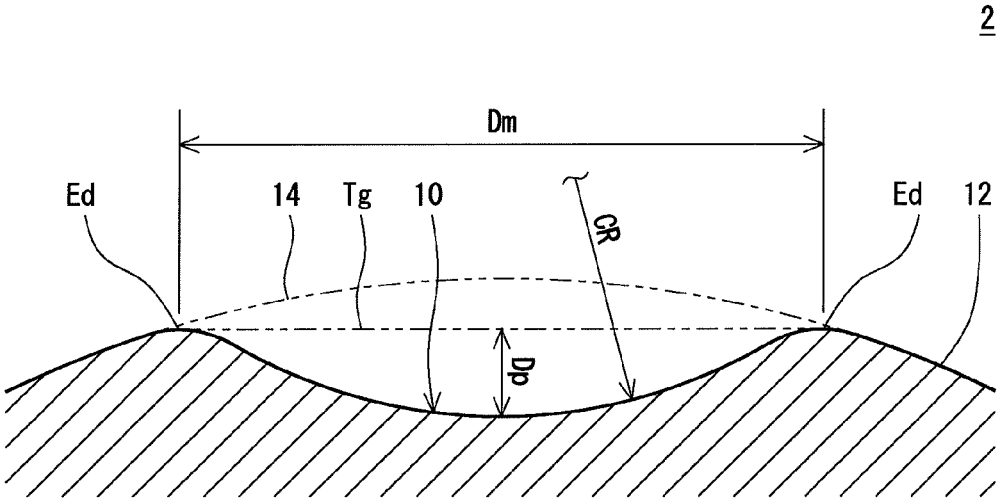
FIG. 4 is a partially enlarged cross-sectional view of the golf ball in FIG. 1.

FIG. 4 shows a cross section along a plane passing through the center of the dimple 10 and the center of the golf ball 2. In FIG. 4, the top-to-bottom direction is the depth direction of the dimple 10. In FIG. 4, what is indicated by a chain double-dashed line 14 is a phantom sphere. The surface of the phantom sphere 14 is the surface of the golf ball 2 when it is postulated that no dimple 10 exists. The dimple 10 is recessed from the surface of the phantom sphere 14. The land 12 agrees with the surface of the phantom sphere 14. In the present embodiment, the cross-sectional shape of each dimple 10 is substantially a circular arc.

In FIG. 4, what is indicated by a double ended arrow Dm is the diameter of the dimple 10. The diameter Dm is the distance between two tangent points Ed appearing on a tangent line Tg that is drawn tangent to the far opposite ends of the dimple 10. Each tangent point Ed is also the edge of the dimple 10. The edge Ed defines the contour of the dimple 10. In FIG. 4, what is indicated by a double ended arrow Dp is the depth of the dimple 10. The depth Dp is the distance between the tangent line Tg and the deepest part of the dimple 10.

In FIG. 4, what is indicated by an arrow CR is the curvature radius of the dimple 10. The curvature radius CR is calculated by the following mathematical formula (1).

$$CR=(Dp^2+Dm^2/4)/(2*Dp) \quad (1)$$

Also in the case of a dimple 10 whose cross-sectional shape is not a circular arc, the curvature radius CR is approximately calculated by the above mathematical formula (1).

In the present embodiment, the curvature radius CR of each dimple A is 16.7 mm; the curvature radius CR of each dimple B is 16.7 mm; the curvature radius CR of each dimple C is 16.7 mm; the curvature radius CR of each dimple D is 16.7 mm; and the curvature radius CR of each dimple E is 16.7 mm. In other words, the curvature radii CR of all the dimples 10 are substantially the same. Due to processing errors of the golf ball 2 and measurement errors of the diameter Dm and the depth Dp, the curvature radius CR of each dimple 10 may be slightly different from 16.7 mm. Such a state is referred to as "substantially the same" in the present invention.

According to the finding by the inventor of the present invention, in the golf ball 2 in which the curvature radii CR of all the dimples 10 are substantially the same, the degree of turbulization is great. The golf ball 2 has excellent flight performance. Even when the curvature radii CR are equalized with each other, the diameter Dm of each type of the dimples can arbitrarily be determined. Therefore, the dimples 10 can densely be arranged. The synergistic effect of the equalized curvature radii CR and the densely arranged dimples 10 achieves excellent flight performance.

The curvature radii CR may be different for each dimple type. In this case as well, the curvature radii CR are preferably less variable. Specifically, the standard deviation σ of the curvature radii CR of all the dimples 10 is preferably equal to or less than 0.90 mm. In the golf ball 2 in which the standard deviation σ is equal to or less than 0.90 mm, the degree of turbulization is great. In light of turbulization, the standard deviation σ is preferably equal to or less than 0.80 mm, more preferably equal to or less than 0.70 mm, and particularly preferably equal to or less than 0.60 mm.

The detailed reason why the golf ball 2 in which the curvature radii CR are less variable has excellent flight performance has not been identified. It is inferred that the fact that the phenomenon caused by backspin regularly occurs near separation points prompts turbulization.

In a first method for determining the standard deviation σ and the average curvature radius Av of the curvature radii CR, the diameters Dm and the depths Dp of all the dimples 10 are measured. The curvature radii CR of all the dimples 10 are calculated on the basis of the above mathematical formula (1). The standard deviation 6 and the average curvature radius Av are calculated on the basis of these curvature radii CR.

Instead of the first method, a second method may conveniently be used. In the second method, first, the average curvature radius Av is calculated on the basis of the following mathematical formula (2).

$$Av=(Ca*108+Cb*78+Cc*20+Cd*100+Ce*18)/324 \quad (2)$$

In the mathematical formula (2), Ca is the curvature radius of the dimple A; Cb is the curvature radius of the dimple B; Cc is the curvature radius of the dimple C; Cd is the curvature radius of the dimple D; and Ce is the curvature radius of the dimple E. Ca is calculated on the basis of the above mathematical formula (1) from measured diameters Dm and depths Dp of a plurality of dimples A that are randomly sampled. Cb is calculated on the basis of the above mathematical formula (1) from measured diameters Dm and depths Dp of a plurality of dimples B that are randomly sampled. Cc is calculated on the basis of the above mathematical formula (1) from measured diameters Dm and depths Dp of a plurality of dimples C that are randomly sampled. Cd is calculated on the basis of the above mathematical formula (1) from measured diameters Dm and depths Dp of a plurality of dimples D that are randomly sampled. Ce is calculated on the basis of the above mathematical formula (1) from measured diameters Dm and depths Dp of a plurality of dimples E that are randomly sampled. The number of the sampled dimples per dimple type is equal to or greater than 4 but equal to or less than 6.

In the second method, the standard deviation σ is calculated on the basis of the following mathematical formula (3).

$$\sigma=(((Ca-Av)^2*108+(Cb-Av)^2*78+(Cc-Av)^2*20+(Cd-Av)^2*100+(Ce-Av)^2*18)/(324-1))^{1/2} \quad (3)$$

According to the finding by the inventor of the present invention, the ratio PC of the average curvature radius Av to the diameter of the golf ball 2 influences the degree of turbulization. There is an appropriate ratio PC corresponding to a flight speed of the golf ball 2. A flight speed depends on a head speed. According to the finding by the inventor of the present invention, the golf ball 2 in which the ratio PC is equal to or greater than 20% but equal to or less than 40% is suitable for a golf player whose head speed of a driver (W#1) is equal to or greater than 45 m/s but equal to or less than 55 m/s. When this golf player hits, with a driver, the golf ball 2 in which the ratio PC is equal to or greater than 20% but equal to or less than 40%, the degree of turbulization is great. When this golf player hits, with a driver, the golf ball 2 in which the ratio PC is equal to or greater than 20% but equal to or less than 40%, a large flight distance is obtained. In light of flight distance, the ratio PC is particularly preferably equal to or greater than 22.8%. In light of flight distance, the ratio PC is more preferably equal to or less than 39.1% and particularly preferably equal to or less than 35%.

As described above, the golf ball 2 has the five types of the dimples 10 having different diameters from each other. From the standpoint that the dimples 10 can densely be arranged, the number of the types of the dimples 10 is preferably equal to or greater than 2, more preferably equal to or greater than 4, and particularly preferably equal to or greater than 5.

The diameter Dm of each dimple 10 is preferably equal to or greater than 2.0 mm but equal to or less than 6.0 mm. The dimple 10 having a diameter Dm of 2.0 mm or greater contributes to turbulization. In this respect, the diameter Dm is more preferably equal to or greater than 2.4 mm and particularly preferably equal to or greater than 2.8 mm. In the golf ball 2 in which the diameter Dm is equal to or less than 6.0 mm, a fundamental feature of the golf ball 2 being substantially a sphere is not impaired. In this respect, the diameter Dm is more preferably equal to or less than 5.6 mm and particularly preferably equal to or less than 5.2 mm.

The golf ball 2 in which the diameter Dm of each dimple 10 is equal to or greater than 3.0 mm but equal to or less than 4.7 mm is suitable for a golf player whose head speed of a driver is equal to or greater than 45 m/s but equal to or less than 55 m/s. When this golf player hits, with a driver, the golf ball 2 in which the diameter Dm is equal to or greater than 3.0 mm but equal to or less than 4.7 mm, the degree of turbulization is great. When this golf player hits, with a driver, the golf ball 2 in which the diameter Dm is equal to or greater than 3.0 mm but equal to or less than 4.7 mm, a large flight distance is obtained.

The average diameter of the dimples 10 is preferably equal to or greater than 3.7 mm but equal to or less than 4.3 mm. The golf ball 2 in which the average diameter is within this range is suitable for a golf player whose head speed of a driver is equal to or greater than 45 m/s but equal to or less than 55 m/s. When this golf player hits, with a driver, the golf ball 2 in which the average diameter is equal to or greater than 3.7 mm but equal to or less than 4.3 mm, the degree of turbulization is great. When this golf player hits, with a driver, the golf ball 2 in which the average diameter is equal to or greater than 3.7 mm but equal to or less than 4.3 mm, a large flight distance is obtained.

The area s of the dimple 10 is the area of a region surrounded by the contour line when the center of the golf ball 2 is viewed at infinity. In the case of a circular dimple 10, the area is calculated by the following mathematical formula.

$$s=(Dm/2)^2*\pi$$

In the golf ball 2 shown in FIGS. 2 and 3, the area of each dimple A is 15.90 $mm^2$; the area of each dimple B is 15.21 $mm^2$; the area of each dimple C is 14.52 $mm^2$; the area of each dimple D is 13.20 $mm^2$; and the area of each dimple E is 10.18 $mm^2$.

The ratio of the sum of the areas s of all the dimples 10 to the surface area of the phantom sphere 14 is referred to as an occupation ratio. In light of turbulization, the occupation ratio is preferably equal to or greater than 75%, more preferably equal to or greater than 80%, and particularly preferably equal to or greater than 81.8%. The occupation ratio is preferably equal to or less than 95%. In the golf ball 2 shown in FIGS. 2 and 3, the total area of all the dimples 10 is 4697.2 $mm^2$. The surface area of the phantom sphere 14 of the golf ball 2 is 5741.5 $mm^2$, and thus the occupation ratio is 81.8%.

In the present invention, the term "volume of the dimple 10" means the volume of a part surrounded by the surface of the dimple 10 and a plane that includes the contour of the dimple 10. In light of suppression of rising of the golf ball 2 during flight, the total volume of all the dimples 10 is preferably equal to or greater than 260 $mm^3$, more preferably equal to or greater than 290 $mm^3$, and particularly preferably equal to or greater than 300 $mm^3$. In light of suppression of dropping of the golf ball 2 during flight, the total volume is preferably equal to or less than 390 $mm^3$ and particularly preferably equal to or less than 370 $mm^3$.

The golf ball 2 in which the total volume is equal to or greater than 310 $mm^3$ but equal to or less than 360 $mm^3$ is suitable for a golf player whose head speed of a driver is equal to or greater than 45 m/s but equal to or less than 55 m/s. When this golf player hits, with a driver, the golf ball 2 in which the total volume is equal to or greater than 310 $mm^3$ but equal to or less than 360 $mm^3$, the degree of turbulization is great. When this golf player hits, with a driver, the golf ball 2 in which the total volume is equal to or greater than 310 $mm^3$ but equal to or less than 360 $mm^3$, a large flight distance is obtained.

In light of being able to contribute to turbulization, the depth Dp is preferably equal to or greater than 0.05 mm, more preferably equal to or greater than 0.06 mm, and particularly preferably equal to or greater than 0.07 mm. In light of suppression of dropping of the golf ball 2 during flight, the depth Dp is preferably equal to or less than 0.24 mm, more preferably equal to or less than 0.21 mm, and particularly preferably equal to or less than 0.19 mm.

The golf ball 2 in which the total number TN of the dimples 10 is equal to or greater than 290 but equal to or less than 480 is suitable for a golf player whose head speed of a driver is equal to or greater than 45 m/s but equal to or less than 55 m/s. When this player hits, with a driver, the golf ball 2 in which the total number TN is equal to or greater than 290 but equal to or less than 480, the degree of turbulization is great. When this player hits, with a driver, the golf ball 2 in which the total number TN is equal to or greater than 290 but equal to or less than 480, a large flight distance is obtained. The total number TN is particularly preferably equal to or greater than 310. The total number TN is more preferably equal to or less than 460 and particularly preferably equal to or less than 440.

The cross-sectional shape of each dimple 10 is preferably an inwardly convex arc. However, the dimple 10 may have an outwardly convex curved surface near the edge Ed. In a zone equal to or greater than 90% of the surface area of the dimple 10, the cross-sectional shape is preferably an inwardly convex arc.

EXAMPLES

Example 1

A rubber composition (a) was obtained by kneading 100 parts by weight of a high-cis polybutadiene (trade name "BR-730", manufactured by JSR Corporation), 39 parts by weight of zinc diacrylate, 5 parts by weight of zinc oxide, an appropriate amount of barium sulfate, 0.5 parts by weight of diphenyl disulfide, and 0.9 parts by weight of dicumyl peroxide (manufactured by NOF Corporation). The rubber composition (a) was placed into a mold including upper and lower mold halves each having a hemispherical cavity, and heated at 170° C. for 18 minutes to obtain a core with a diameter of 39.75 mm. The amount of barium sulfate was adjusted such that a golf ball with a weight 45.6 g was obtained.

A resin composition (c) was obtained by kneading 50 parts by weight of an ionomer resin (the aforementioned "Himilan 1605"), 50 parts by weight of another ionomer resin (the aforementioned "Himilan AM7329"), 4 parts by weight of titanium dioxide, and 0.04 parts by weight of ultramarine blue with a twin-screw kneading extruder. The core was covered with the resin composition (c) by injection molding to form a mid layer with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type solid epoxy resin and 70 parts by weight of a solvent. The curing agent liquid of this paint composition includes 40 parts by weight of a modified polyamide amine, 55 parts by weight of a solvent, and 5 parts by weight of titanium oxide. The weight ratio of the base material liquid to the curing agent liquid is 1/1. This paint composition was applied to the surface of the mid layer with a spray gun, and kept at 23° C. for 6 hours to obtain a reinforcing layer with a thickness of 10 μm.

A resin composition (e) was obtained by kneading 100 parts by weight of a thermoplastic polyurethane elastomer (the aforementioned "Elastollan XNY85A") and 4 parts by weight of titanium dioxide with a twin-screw kneading extruder. Half shells were obtained from the resin composition (e) by compression molding. The sphere consisting of the core, the mid layer, and the reinforcing layer was covered with two of these half shells. The half shells and the sphere were placed into a final mold that includes upper and lower mold halves each having a hemispherical cavity and having a large number of pimples on the cavity face thereof, and a cover was obtained by compression molding. The thickness of the cover was 0.5 mm. A large number of dimples having a shape that is the inverted shape of the pimples were formed on the cover. A clear paint including a two-component curing type polyurethane as a base material was applied to this cover to obtain a golf ball of Example 1 with a diameter of 42.75 mm and a weight of about 45.6 g. The golf ball has a dimple pattern shown in FIGS. 2 and 3. The detailed specifications of the dimples are shown in Table 4 below.

Examples 2 to 7 and Comparative Examples 1 to 5

Golf balls of Examples 2 to 7 and Comparative Examples 1 to 5 were obtained in the same manner as Example 1, except the structure of the golf ball and the specifications of the dimples were changed. The detailed specifications of the core are shown in Table 1 below. The detailed specifications of the mid layer and the cover are shown in Table 2 below. The detailed specifications of the dimples are shown in Tables 4 to 6 below.

TABLE 1

Composition of Core

| Type | a | b |
|---|---|---|
| Polybutadiene | 100 | 100 |
| Zinc diacrylate | 39 | 29 |
| Zinc oxide | 5 | 5 |
| Barium sulfate | Appropriate amount | Appropriate amount |
| Diphenyl disulfide | 0.5 | 0.5 |
| Dicumyl peroxide | 0.9 | 0.9 |

TABLE 2

Composition of Mid Layer and Cover

| Type | c | d | e | f |
|---|---|---|---|---|
| Himilan 1605 | 50 | | — | 10 |
| Himilan AM7329 | 50 | 50 | — | 50 |
| Himilan AM7337 | — | 24 | — | 10 |
| Rabalon T3221C | — | 26 | — | — |
| Elastollan XNY85A | — | — | 100 | — |
| NUCREL 1050H* | — | — | — | 30 |
| Titanium dioxide | 4 | 4 | 4 | 4 |
| Ultramarine blue | 0.04 | 0.04 | 0.04 | 0.04 |

*Ethylene-methacrylic acid copolymer (manufactured by Du Pont-MITSUI POLYCHEMICALS Co., Ltd.)

TABLE 3

| Structure of Golf Ball | | |
|---|---|---|
| Type | I | II |
| Composition of core | a | b |
| Diameter (mm) of core | 39.75 | 39.15 |
| Composition of mid layer | c | d |
| Thickness (mm) of mid layer | 1.0 | 1.0 |
| Composition of cover | e | f |
| Thickness (mm) of cover | 0.5 | 0.8 |
| Diameter (mm) of golf ball | 42.75 | 42.75 |

TABLE 4

| Specifications of Dimples | | | | | | |
|---|---|---|---|---|---|---|
| | Type | Number of dimples | Diameter Dm (mm) | Depth Dp (mm) | Radius CR (mm) | Volume ($mm^3$) |
| Example 1 | A | 108 | 4.50 | 0.1523 | 16.7 | 1.213 |
| | B | 78 | 4.40 | 0.1456 | 16.7 | 1.109 |
| | C | 20 | 4.30 | 0.1391 | 16.7 | 1.011 |
| | D | 100 | 4.10 | 0.1263 | 16.7 | 0.835 |
| | E | 18 | 3.60 | 0.0973 | 16.7 | 0.496 |
| Compa. Example 1 | A | 108 | 4.50 | 0.1403 | 18.1 | 1.117 |
| | B | 78 | 4.40 | 0.1403 | 17.3 | 1.068 |
| | C | 20 | 4.30 | 0.1403 | 16.5 | 1.020 |
| | D | 100 | 4.10 | 0.1403 | 15.0 | 0.928 |
| | E | 18 | 3.60 | 0.1403 | 11.6 | 0.715 |
| Compa. Example 2 | A | 108 | 4.50 | 0.1463 | 17.4 | 1.165 |
| | B | 78 | 4.40 | 0.1431 | 17.0 | 1.089 |
| | C | 20 | 4.30 | 0.1398 | 16.6 | 1.017 |
| | D | 100 | 4.10 | 0.1333 | 15.8 | 0.881 |
| | E | 18 | 3.60 | 0.1171 | 13.9 | 0.597 |
| Example 2 | A | 108 | 4.50 | 0.1523 | 16.7 | 1.213 |
| | B | 78 | 4.40 | 0.1456 | 16.7 | 1.109 |
| | C | 20 | 4.30 | 0.1391 | 16.7 | 1.011 |
| | D | 100 | 4.10 | 0.1263 | 16.7 | 0.835 |
| | E | 18 | 3.60 | 0.0973 | 16.7 | 0.496 |

TABLE 5

| Specifications of Dimples | | | | | | |
|---|---|---|---|---|---|---|
| | Type | Number of dimples | Diameter Dm (mm) | Depth Dp (mm) | Radius CR (mm) | Volume ($mm^3$) |
| Compa. Example 3 | A | 108 | 4.50 | 0.1463 | 17.4 | 1.165 |
| | B | 78 | 4.40 | 0.1431 | 17.0 | 1.089 |
| | C | 20 | 4.30 | 0.1398 | 16.6 | 1.017 |
| | D | 100 | 4.10 | 0.1333 | 15.8 | 0.881 |
| | E | 18 | 3.60 | 0.1171 | 13.9 | 0.597 |
| Compa. Example 4 | A | 108 | 4.50 | 0.1384 | 18.4 | 1.102 |
| | B | 78 | 4.40 | 0.1323 | 18.4 | 1.007 |
| | C | 20 | 4.30 | 0.1264 | 18.4 | 0.919 |
| | D | 100 | 4.10 | 0.1148 | 18.4 | 0.758 |
| | E | 18 | 3.60 | 0.0884 | 18.4 | 0.450 |
| Example 3 | A | 20 | 4.40 | 0.1717 | 14.2 | 1.308 |
| | B | 160 | 4.05 | 0.1452 | 14.2 | 0.937 |
| | C | 200 | 3.90 | 0.1347 | 14.2 | 0.806 |
| | D | 12 | 2.90 | 0.0743 | 14.2 | 0.246 |
| Example 4 | A | 132 | 3.90 | 0.1966 | 9.8 | 1.178 |
| | B | 180 | 3.53 | 0.1609 | 9.8 | 0.789 |
| | C | 60 | 3.20 | 0.1320 | 9.8 | 0.532 |
| | D | 60 | 3.03 | 0.1183 | 9.8 | 0.427 |
| Example 5 | A | 50 | 4.30 | 0.1888 | 12.3 | 1.375 |
| | B | 210 | 3.90 | 0.1551 | 12.3 | 0.929 |
| | C | 120 | 3.50 | 0.1248 | 12.3 | 0.602 |
| | D | 40 | 3.30 | 0.1109 | 12.3 | 0.475 |

TABLE 6

| Specifications of Dimples | | | | | | |
|---|---|---|---|---|---|---|
| | Type | Number of dimples | Diameter Dm (mm) | Depth Dp (mm) | Radius CR (mm) | Volume ($mm^3$) |
| Compa. Example 5 | A | 120 | 3.65 | 0.2004 | 8.4 | 1.053 |
| | B | 120 | 3.05 | 0.1394 | 8.4 | 0.511 |
| | C | 392 | 2.85 | 0.1216 | 8.4 | 0.389 |
| Example 6 | A | 108 | 4.50 | 0.1558 | 16.3 | 1.241 |
| | B | 78 | 4.40 | 0.1472 | 16.5 | 1.121 |
| | C | 20 | 4.30 | 0.1380 | 16.8 | 1.003 |
| | D | 100 | 4.10 | 0.1226 | 17.2 | 0.810 |
| | E | 18 | 3.60 | 0.0812 | 20.0 | 0.414 |
| Example 7 | A | 108 | 4.50 | 0.1546 | 16.5 | 1.231 |
| | B | 78 | 4.40 | 0.1465 | 16.6 | 1.115 |
| | C | 20 | 4.30 | 0.1380 | 16.8 | 1.003 |
| | D | 100 | 4.10 | 0.1240 | 17.0 | 0.820 |
| | E | 18 | 3.60 | 0.0870 | 18.7 | 0.443 |

[Flight Distance Test]

A driver with a titanium head (trade name "Z-TX", manufactured by SRI Sports Limited, shaft hardness: X, loft angle: 8.5°) was attached to a swing machine manufactured by True Temper Co. A golf ball was hit under the condition of a head speed of 50 m/sec, and the distance from the launch point to the stop point was measured. At the test, the weather was almost windless. The average value of data obtained by 10 measurements is shown in Tables 7 and 8 below.

TABLE 7

| Results of Evaluation | | | | | | |
|---|---|---|---|---|---|---|
| | Ex. 1 | Compa. Ex. 1 | Compa. Ex. 2 | Ex. 2 | Compa. Ex. 3 | Compa. Ex. 4 |
| Ball structure | I | I | I | II | II | I |
| Plan view | FIG. 2 | FIG. 2 | FIG. 2 | FIG. 2 | FIG. 2 | FIG. 2 |
| Front view | FIG. 3 | FIG. 3 | FIG. 3 | FIG. 3 | FIG. 3 | FIG. 3 |
| Number of types of dimples | 5 | 5 | 5 | 5 | 5 | 5 |
| Total number TN | 324 | 324 | 324 | 324 | 324 | 324 |
| Average curvature radius Av (mm) | 16.7 | 16.5 | 16.6 | 16.7 | 16.6 | 18.4 |
| Standard deviation σ (mm) | 0 * | 1.74 | 0.91 | 0 * | 0.91 | 0 * |
| Ratio PC (%) | 39.1 | 38.6 | 38.7 | 39.1 | 38.7 | 43.0 |
| Total volume ($mm^3$) | 330 | 330 | 330 | 330 | 330 | 300 |
| Average diameter (mm) | 4.29 | 4.29 | 4.29 | 4.29 | 4.29 | 4.29 |
| Occupation ratio (%) | 81.8 | 81.8 | 81.8 | 81.8 | 81.8 | 81.8 |
| Flight distance (m) | 257.0 | 250.0 | 253.5 | 251.0 | 250.5 | 253.0 |

* Substantially zero

TABLE 8

Figure 5:
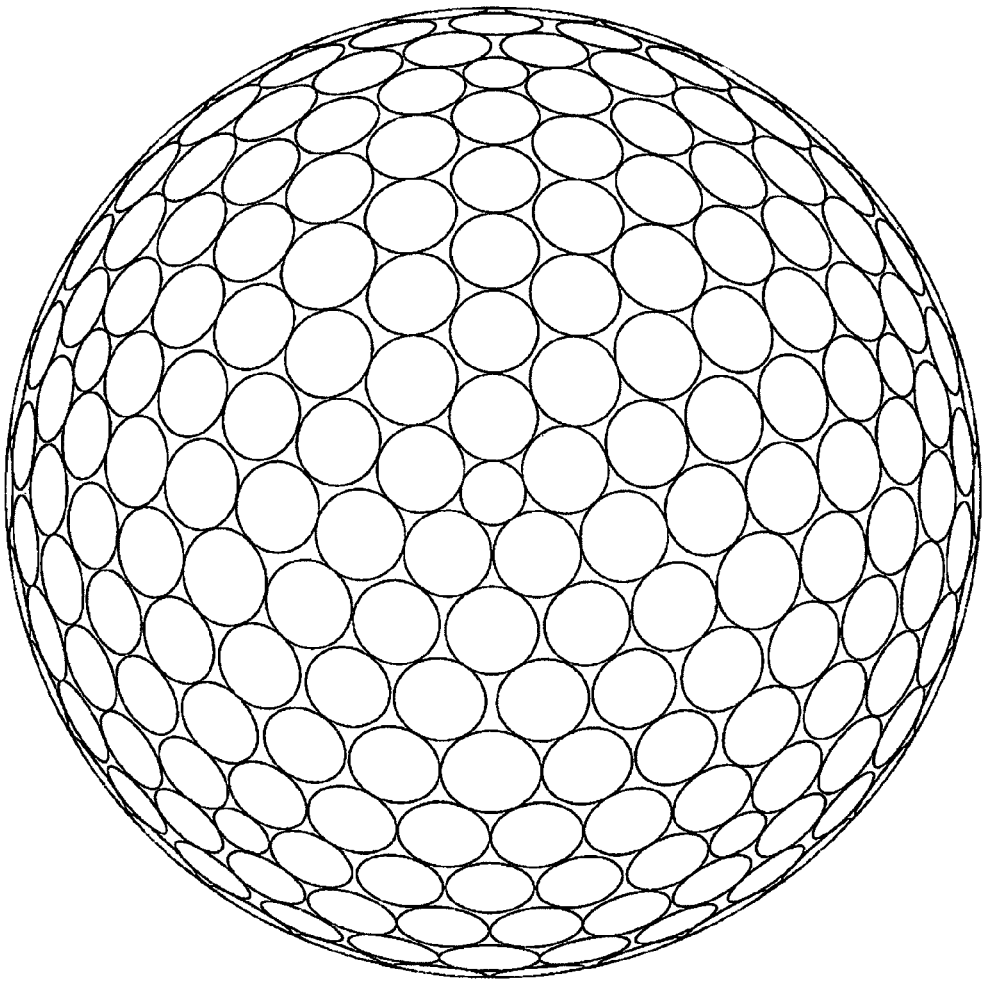
FIG. 5 is a plan view of a golf ball according to Example 3 of the present invention.
Figure 6:
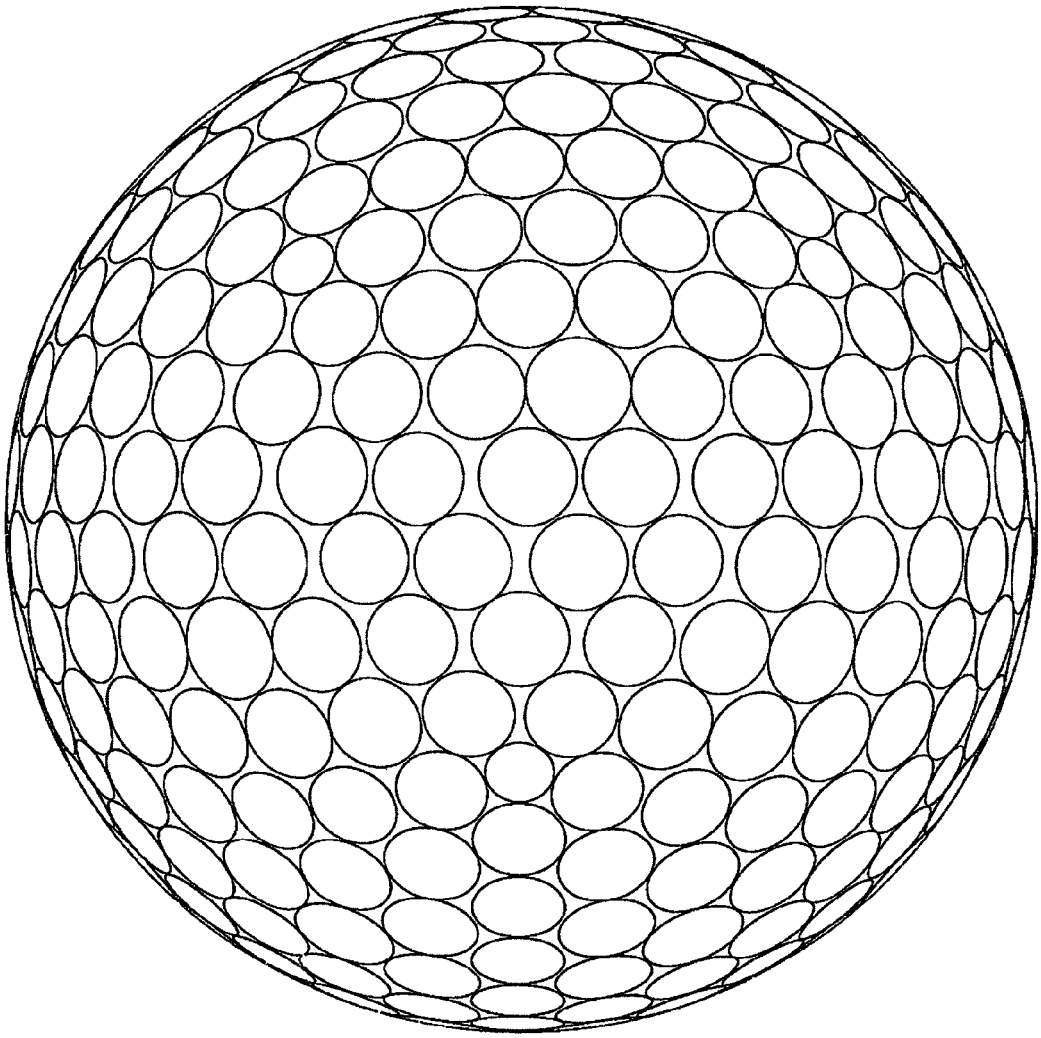
FIG. 6 is a front view of the golf ball in FIG. 5.
Figure 7:
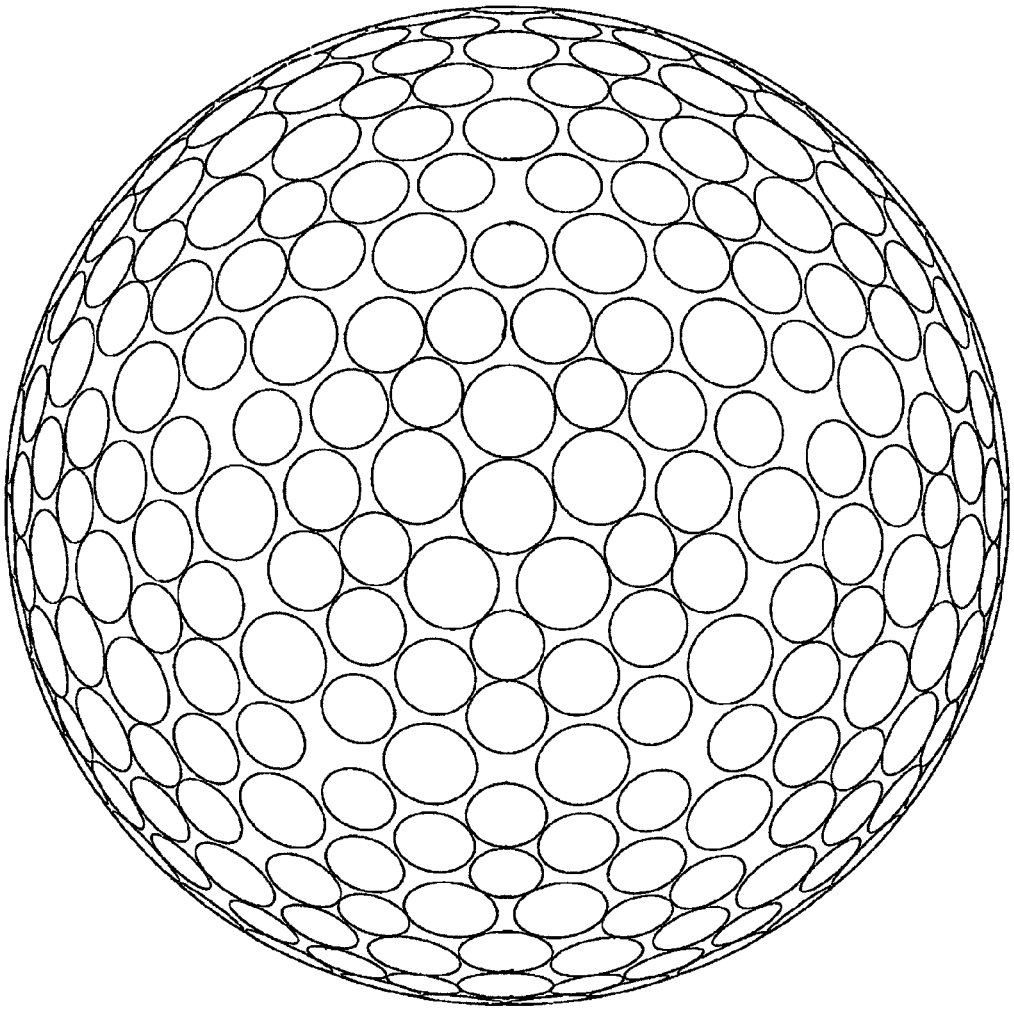
FIG. 7 is a plan view of a golf ball according to Example 4 of the present invention.
Figure 8:
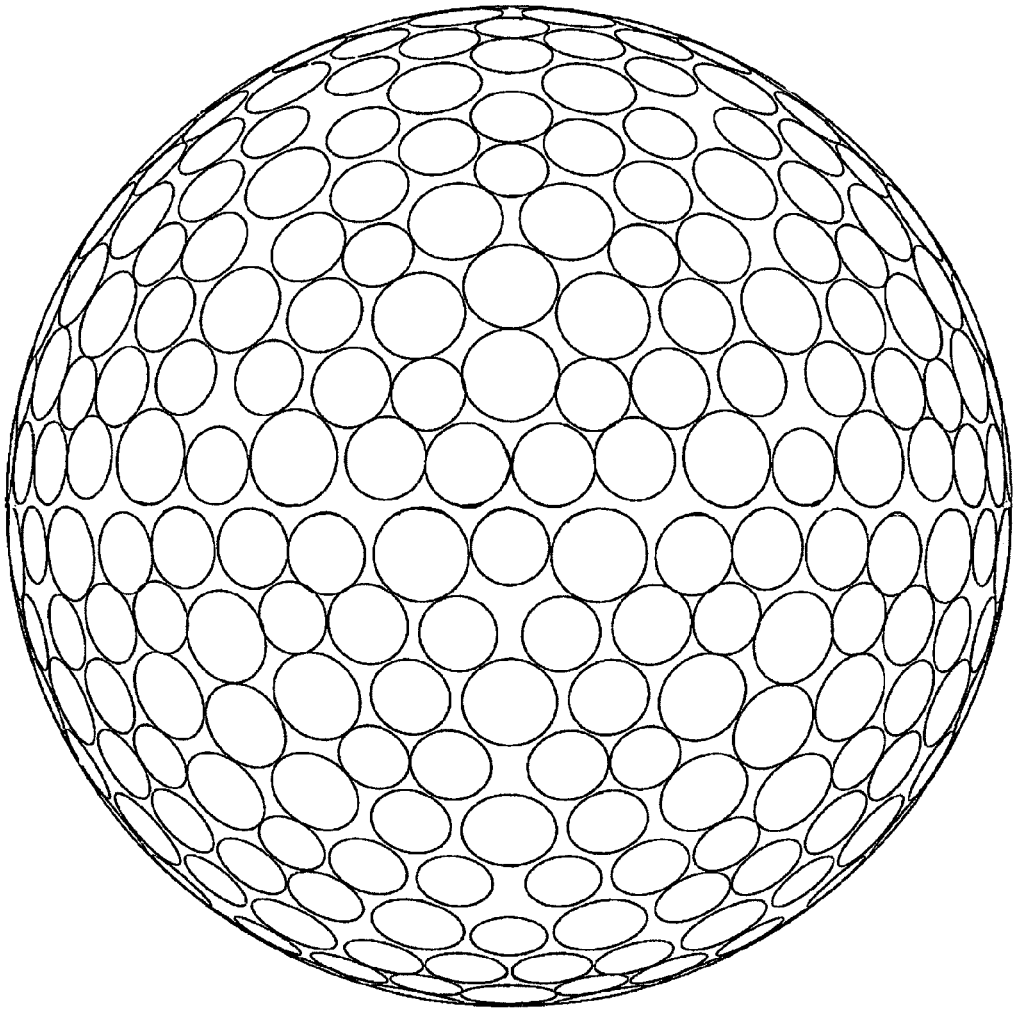
FIG. 8 is a front view of the golf ball in FIG. 7.
Figure 9:
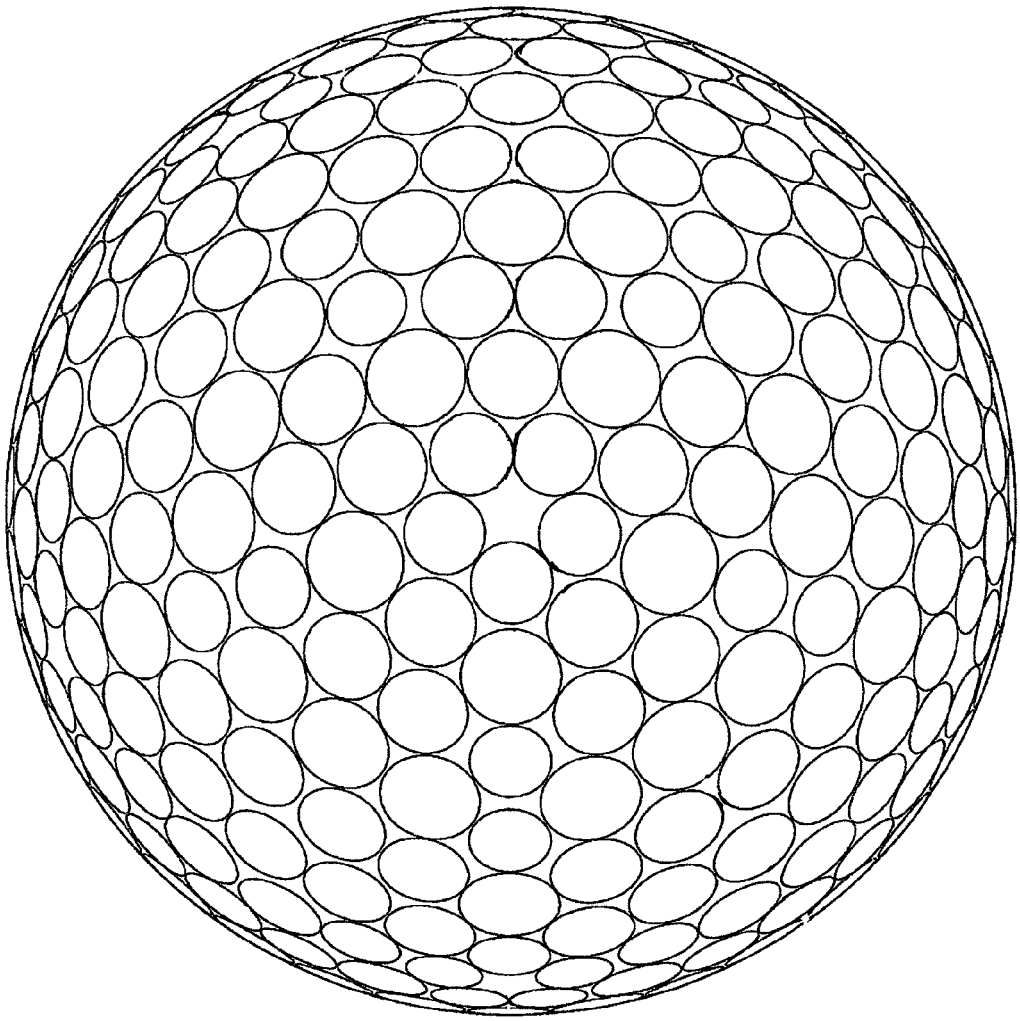
FIG. 9 is a plan view of a golf ball according to Example 5 of the present invention.
Figure 10:
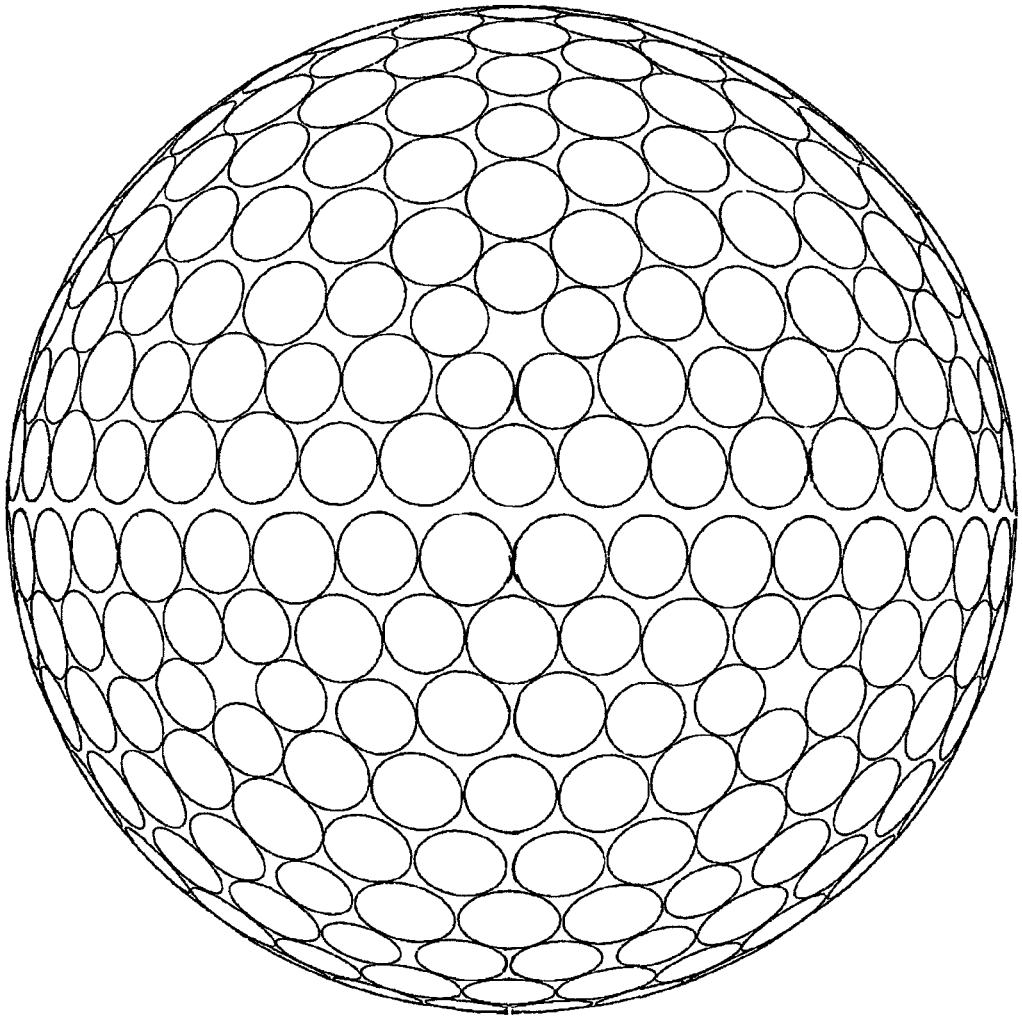
FIG. 10 is a front view of the golf ball in FIG. 9.
Figure 11:
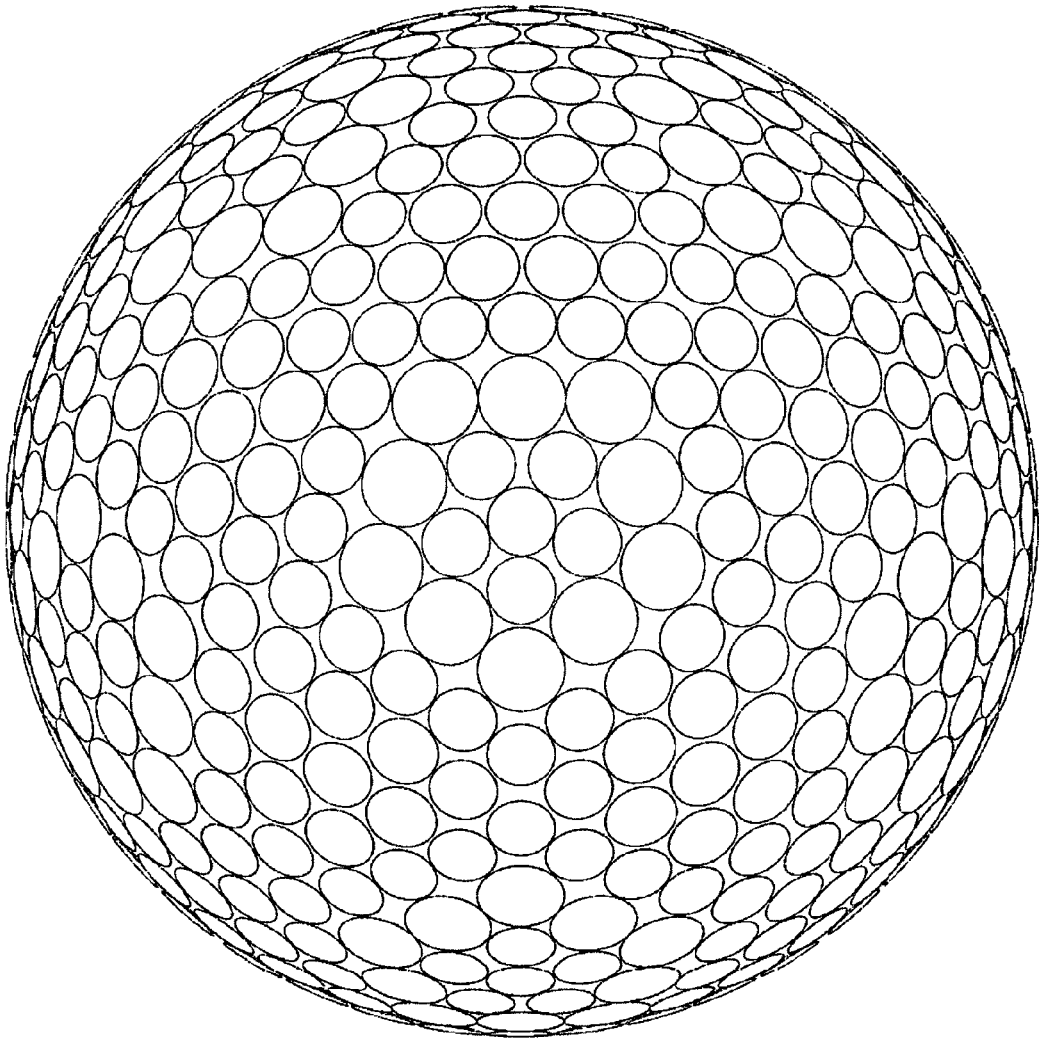
FIG. 11 is a plan view of a golf ball according to Comparative Example 5.
Figure 12:
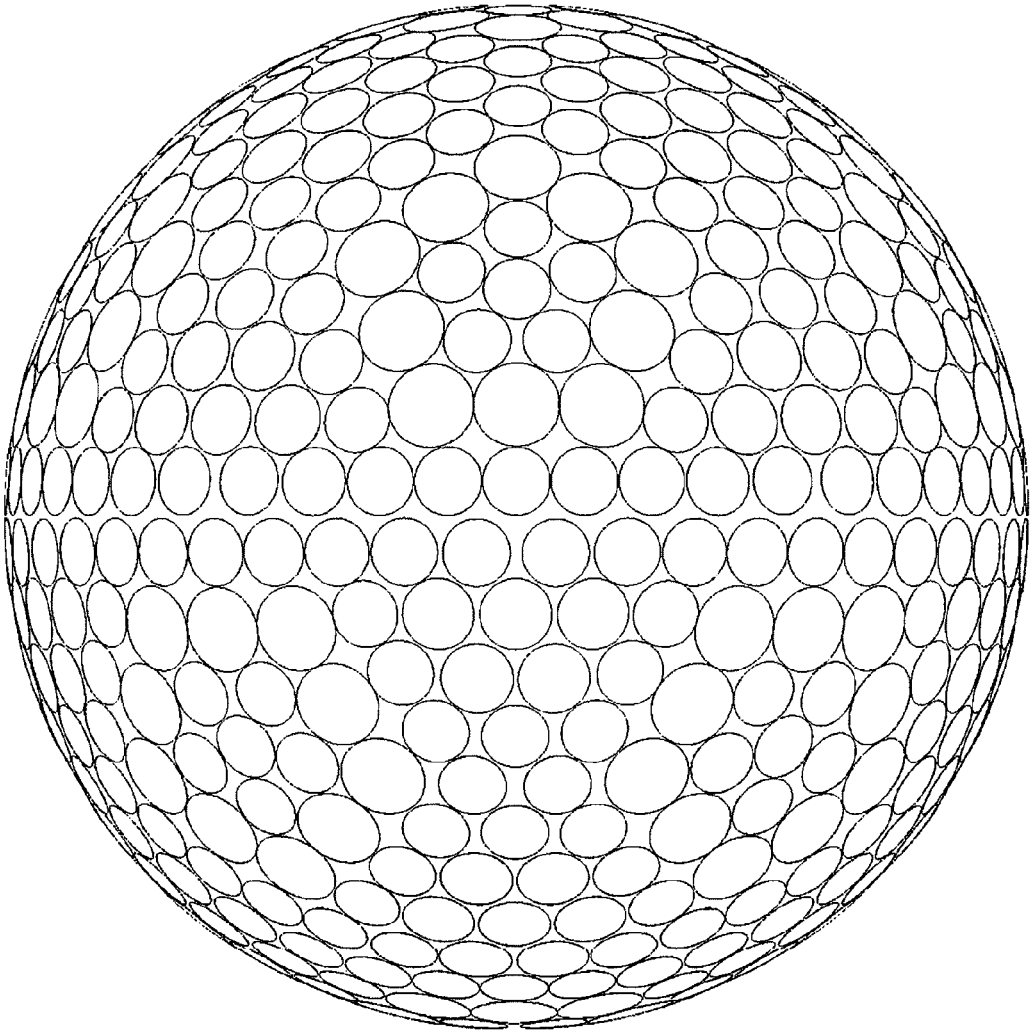
FIG. 12 is a front view of the golf ball in FIG. 11.

| Results of Evaluation | | | | | | |
|---|---|---|---|---|---|---|
| | Ex. 3 | Ex. 4 | Ex. 5 | Compa. Ex. 5 | Ex. 6 | Ex. 7 |
| Ball structure | I | I | I | I | I | I |
| Plan view | FIG. 5 | FIG. 7 | FIG. 9 | FIG. 11 | FIG. 2 | FIG. 2 |
| Front view | FIG. 6 | FIG. 8 | FIG. 10 | FIG. 12 | FIG. 3 | FIG. 3 |
| Number of | 4 | 4 | 4 | 3 | 5 | 5 |

TABLE 8-continued

| Results of Evaluation | | | | | | |
|---|---|---|---|---|---|---|
| | Ex. 3 | Ex. 4 | Ex. 5 | Compa. Ex. 5 | Ex. 6 | Ex. 7 |
| types of dimples | | | | | | |
| Total number TN | 392 | 432 | 420 | 632 | 324 | 324 |
| Average curvature radius Av (mm) | 14.2 | 9.8 | 12.3 | 8.4 | 16.9 | 16.8 |
| Standard deviation σ (mm) | 0 * | 0 * | 0 * | 0 * | 0.84 | 0.51 |
| Ratio PC (%) | 33.2 | 22.8 | 28.8 | 19.7 | 39.5 | 39.3 |
| Total volume ($mm^3$) | 340 | 355 | 355 | 340 | 330 | 330 |
| Average diameter (mm) | 3.96 | 3.53 | 3.78 | 3.04 | 4.29 | 4.29 |
| Occupation ratio (%) | 84.2 | 74.1 | 82.4 | 80.7 | 81.8 | 81.8 |
| Flight distance (m) | 256.0 | 254.0 | 255.5 | 253.5 | 254.5 | 255.5 |

* Substantially zero

As shown in Tables 7 and 8, the golf ball of each Example has excellent flight performance. From the results of evaluation, advantages of the present invention are clear.

The aforementioned dimples are applicable to a one-piece golf ball, a two-piece golf ball, a four-piece golf ball, a five-piece golf ball, and a thread-wound golf ball, in addition to a three-piece golf ball. The above descriptions are merely for illustrative examples, and various modifications can be made without departing from the principles of the present invention.

What is claimed is:

1. A golf ball having, on a surface thereof, a plurality of types of dimples having different diameters from each other, wherein a standard deviation of curvature radii of cross sections of all the dimples is equal to or less than 0.90 mm, and an average of the curvature radii of the cross sections of all the dimples is equal to or greater than 20% of a diameter of the golf ball but equal to or less than 40% of the diameter of the golf ball.

2. The golf ball according to claim 1, wherein the average of the curvature radii of the cross sections of all the dimples is equal to or greater than 20% of the diameter of the golf ball but equal to or less than 35% of the diameter of the golf ball.

3. The golf ball according to claim 1, wherein a sum of volumes of all the dimples is equal to or greater than 300 $mm^3$ but equal to or less than 370 $mm^3$.

4. The golf ball according to claim 3, wherein the sum is equal to or greater than 310 $mm^3$ but equal to or less than 360 $mm^3$.

5. The golf ball according to claim 1, wherein an average of the diameters of all the dimples is equal to or greater than 3.5 mm but equal to or less than 4.5 mm.

6. The golf ball according to claim 1, wherein the diameter of each dimple is equal to or greater than 3.0 mm but equal to or less than 4.7 mm.

7. The golf ball according to claim 1, wherein a ratio of a sum of areas of all the dimples to a surface area of a phantom sphere of the golf ball is equal to or greater than 75% but equal to or less than 95%.

8. The golf ball according to claim 1, wherein a depth of each dimple is equal to or greater than 0.05 mm but equal to or less than 0.24 mm.

9. The golf ball according to claim 1, wherein a total number of the dimples is equal to or greater than 310 but equal to or less than 440.

10. The golf ball according to claim 1, wherein the golf ball comprises a core and a cover, the cover is formed from a resin composition, and a base resin of the resin composition is a polyurethane.

11. The golf ball according to claim 10, wherein the polyurethane is a thermoplastic polyurethane elastomer that includes a polyurethane component as a hard segment and a soft segment, and a curing agent for the polyurethane component is an alicyclic diisocyanate.

12. The golf ball according to claim 10, wherein a Shore D hardness of the cover is equal to or greater than 30 but equal to or less than 60.

13. The golf ball according to claim 10, wherein a thickness of the cover is equal to or greater than 0.1 mm but equal to or less than 0.8 mm.

* * * * *